US005189814A

United States Patent [19]

Barma

[11] Patent Number: 5,189,814

[45] Date of Patent: Mar. 2, 1993

[54] REINFORCED RUBBER FOOTWEAR PRODUCT

[75] Inventor: Tarachand S. Barma, La Crosse, Wis.

[73] Assignee: La Crosse Footwear, Inc., La Crosse, Wis.

[21] Appl. No.: 495,021

[22] Filed: Mar. 16, 1990

[51] Int. Cl.[5] ..... A43B 13/42; A43B 1/10

[52] U.S. Cl. ..... 36/4; 36/68; 36/55; 12/142 E

[58] Field of Search ..... 36/4, 68, 69, 85, 105, 36/55; 12/142 E

[56] References Cited

U.S. PATENT DOCUMENTS

| | | | |
|---|---|---|---|
| Re. 9,080 | 1/1880 | Van Wormer | 36/68 |
| 215,184 | 5/1879 | Thompson | 36/68 |
| 1,047,504 | 12/1912 | Crowley . | |
| 1,161,879 | 11/1915 | Payne . | |
| 1,890,890 | 12/1932 | Van Dinter et al. | 36/4 |
| 2,160,590 | 5/1939 | Guhman | 36/68 |
| 2,212,580 | 8/1940 | Ayers | 36/68 |
| 2,244,504 | 6/1941 | Riddell | 36/68 |
| 2,426,211 | 6/1945 | Heckman | 36/4 |
| 2,438,280 | 3/1948 | Gailey | 36/68 X |
| 3,333,353 | 8/1967 | Garcia . | |
| 3,742,623 | 7/1973 | Groothaert . | |
| 3,851,411 | 12/1974 | Crosbie et al. | 36/68 |
| 3,964,951 | 6/1976 | Kremer et al. | 36/68 X |
| 4,198,769 | 4/1980 | Rigon . | |
| 4,202,117 | 5/1980 | Bidegain | 36/105 X |
| 4,255,877 | 3/1981 | Bowerman | 36/68 X |
| 4,624,015 | 11/1986 | Bottoms . | |
| 4,703,533 | 11/1987 | Barma . | |
| 4,706,316 | 11/1987 | Tanzi | 36/55 X |
| 4,821,430 | 4/1989 | Flemming et al. . | |
| 4,827,631 | 5/1989 | Thornton . | |
| 4,878,301 | 11/1989 | Kiyosawa . | |

FOREIGN PATENT DOCUMENTS

| | | | |
|---|---|---|---|
| 871222 | 5/1971 | Canada . | |
| 3342422 | 8/1984 | Fed. Rep. of Germany . | |
| 3527286 | 3/1986 | Fed. Rep. of Germany . | |
| 364958 | 1/1932 | United Kingdom | 36/4 |

*Primary Examiner*—Paul T. Sewell
*Assistant Examiner*—Ted Kavanaugh
*Attorney, Agent, or Firm*—Foley & Lardner

[57] ABSTRACT

The present invention provides a rubber footwear product having superior heel support as compared with conventional rubber footwear products, and a method of manufacturing such a product. More particularly, the invention provides a rubber footwear product in which a heel counter is trapped or embedded within the vulcanizate to improve the support provided to the wearer's foot.

14 Claims, 3 Drawing Sheets

REINFORCED RUBBER FOOTWEAR PRODUCT

TECHNICAL FIELD

This invention generally relates to rubber footwear products and the manufacture thereof. More particularly, this invention relates to the manufacture of rubber footwear products wherein the posterior or heel portion is reinforced.

BACKGROUND OF THE INVENTION

In the conventional manufacture of a rubber footwear product, uncured rubber or rubber coated fabrics are first cut to a desired size for a specific part of the footwear product, and then assembled on a forming device, such as a metal last. The metal last has the internal shape and size of the desired footwear product. Generally, an uncured rubber upper and an uncured rubber insole are first positioned on the last. The ends are lasted so that they adhesively overlap each other. An uncured flat band (foxing band) is then placed around the outer periphery of the rubber upper. This band is then lasted onto the upper. An uncured binder or filler is then placed on the insole, so that a substantial portion of the insole is covered. An uncured rubber outsole is then lasted over the projecting edge of the insole onto the uncured rubber upper so that it adhesively attaches to the upper.

This uncured rubber assembly is vulcanized, generally for about 1–2 hours at temperatures ranging from about 200 to 400° F. Vulcanization serves to chemically and physically meld the component parts by crosslinking of the uncured rubber into a complete vulcanizate footwear product so that the resulting footwear product has a unitary construction. Cross-linking occurs not only within each of the individual assembled component parts, but also between each part. This process of melding the several layers or component parts of the footwear product is referred to hereafter as "intervulcanization".

This conventional process of manufacture of rubber footwear products, relying on intervulcanization of the component parts, places severe constraints on the type of rubber footwear which can be produced. Rubber of the types used in the conventional rubber footwear manufacture process is flexible and does not provide rigid support as is common in other kinds of footwear. Nevertheless, this process does have desirable attributes, such as rendering a product resistant to air, gas, sunlight, hydrocarbons, moisture penetration, fats and oils, acid and other chemicals, as well as providing a product having excellent durability, wear, strength, and other structural properties. It would thus be desirable to maintain these attributes yet provide a rubber footwear product having improved structural properties. One such property is heel support.

While I have previously recognized that it would be desirable for the rubber footwear industry to be able to incorporate many of the desirable attributes of other footwear products into a footwear vulcanizate in my U.S. Pat. No. 4,703,533 issued Nov. 3, 1987, heretofore the need to provide support of the heel has not been recognized in the rubber footwear industry. This is primarily because, as noted above, formation of a unitary rubber footwear product relies on intervulcanization of the component parts. Thus, non-rubber heel reinforcements have not been used in rubber footwear products. Providing such a reinforcement in the heel portion of a footwear product would prevent intervulcanization in that area, and the footwear product would be susceptible to failure in that area. Thus, known rubber footwear products are flimsy and unsupported in the region of the heel.

Heel supports, or heel counters, are known. See, for example, Kayiosawa, U.S. Pat. No. 4,878,301 issued Nov. 7, 1989; Flenning, et al., U.S. Pat. No. 4,821,430 issued Apr. 18, 1989; and Garcia. U.S. Pat. No. 3,333,353 issued Aug. 1, 1967. These counters provide support to the heel or heel and shank portions of the footwear product.

Heel counters or supports having a reinforcing cup are used in leather footwear products such as athletic shoes and the like. See, for example, Thornton, U.S Pat. No. 4,827,631 issued May 1, 1989; and Bauer, et al., German Patent Publication No. 3,342,422 published Nov. 24, 1983. Such athletic shoes are made of foam, cloth, leather or similar materials. Heel counters have also been used on the outside of athletic-type shoes such as karate and kickboxing boots. See, Bottoms, U.S. Pat. No. 4,624,015 issued Nov. 25, 1986.

Reinforced heels have also been used in injection-molded plastic boots, and several techniques are known for providing a reinforced arch and heel construction in such boots. One such technique involves the incorporation of a reinforced insole member with a rigid heel portion into the traditional molding process; see Rigon, U.S. Pat. No. 4,198,769 issued Apr. 22, 1980. Another technique involves filling the heel cavity in the process of slush molding boots from a liquid plastic dispersion; see Rybka, Canadian Patent No. 871,222 issued May 18, 1971.

It is also known to add heel support or cushioning devices to rubber overshoes, such as galoshes, overshoes or rubbers. See, for example, Crowley, U.S. Pat. No. 1,047,504 issued Dec. 17, 1912 and Payne, U.S Pat. No. 1,161,879 issued Nov. 30, 1915.Use of these supports or devices, however, have heretofore been unknown in the manufacture of the rubber footwear products which these overshoes or coverings serve to protect.

Coatings applied exteriorly to the heel of rubber footwear products are known. See, German Patent Publication No. 3,434,353 published Sep. 19, 1984. Such exteriorly applied devices, however, fail to provide adequate support to the heel region of the foot and the underlying tarsal bones. Particularly, the calcaneus, the largest and most posterior of the tarsal bones forming the prominence of the heel, is relatively unsupported in such constructions.

Also known are interiorly applied inserts, such as heel cups or wear elements. These wear elements, which may, for example, be inserted into the heel region of felt-lined boots, such as rubber boots worn by firemen, are used to prevent wear of the felt in the area normally subject to rubbing from the heel portion of the foot. See, Groothaert, U.S. Pat. No. 3,742,623 issued Jul. 3, 1973. These can slip or otherwise move about the inside of the footwear product if not well adhered to the inside of the footwear product, and subsequent use may cause the insert to loosen. It is therefore desirable to provide a rubber footwear product which includes a heel support or heel counter which is embedded within the footwear product.

SUMMARY OF THE INVENTION

The present invention provides a rubber footwear product having superior heel support as compared with conventional rubber footwear products, and a method of manufacturing such a product. More particularly, the invention provides a rubber footwear product in which a heel counter is trapped or embedded within the vulcanizate to improve the support provided to the wearer's foot.

BRIEF DESCRIPTION OF THE DRAWINGS

A preferred exemplary embodiment of the present invention will hereinafter be described in conjunction with the appended drawings, wherein like numerals denote like elements, and.

DETAILED DESCRIPTION OF THE PREFERRED EMBODIMENT

Figure 1:
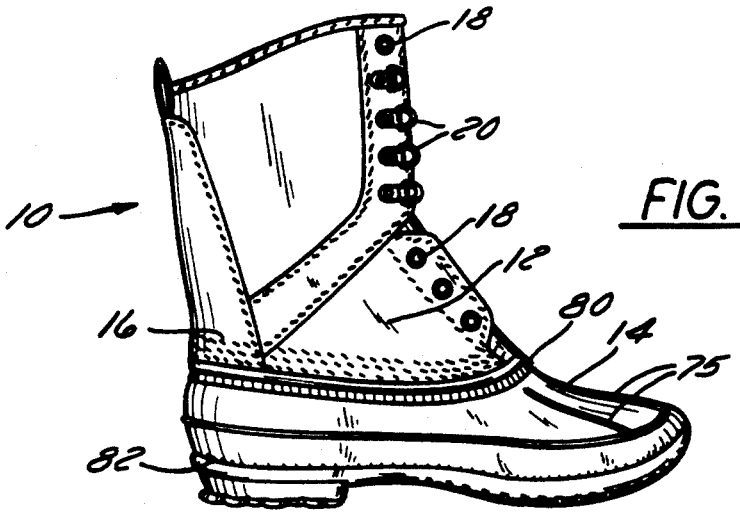
FIG. 1 is a side view of a rubber boot of the invention.
Figure 2:
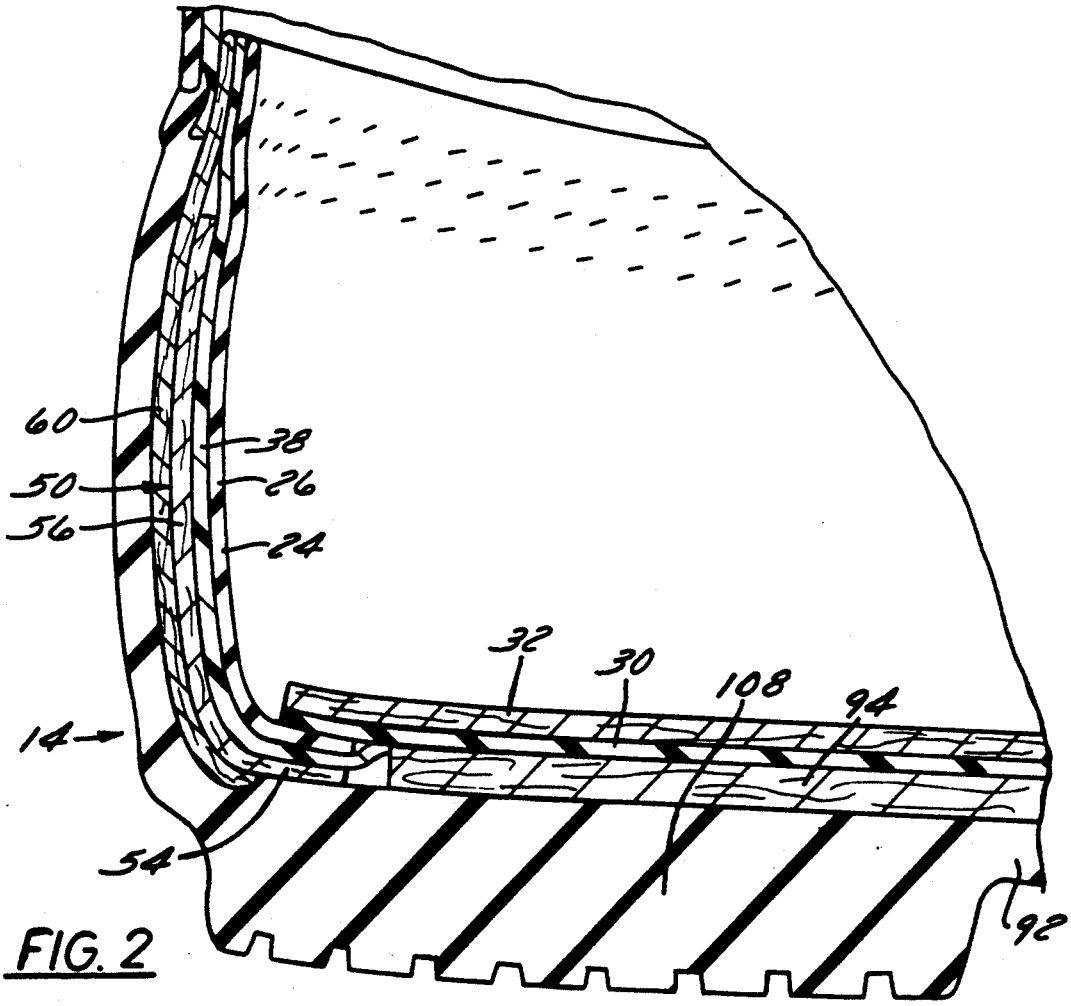
FIG. 2 is a partial lengthwise sectional view of the boot of FIG. 1.

With reference to FIGS. 1 and 2, a rubber footwear product in the form of a boot 10 in accordance with the present invention includes an upper portion 12 and a lower portion 14. Upper portion 12 is preferably joined to lower portion 14 such as by a sewn seam 16 subsequent to the formation and processing of lower portion 14. Upper portion 12 is of conventional design and is typically made of leather or similar materials. Eyelets 18 and 20 formed in upper 12 around the tongue to facilitate lacing.

Figure 3:
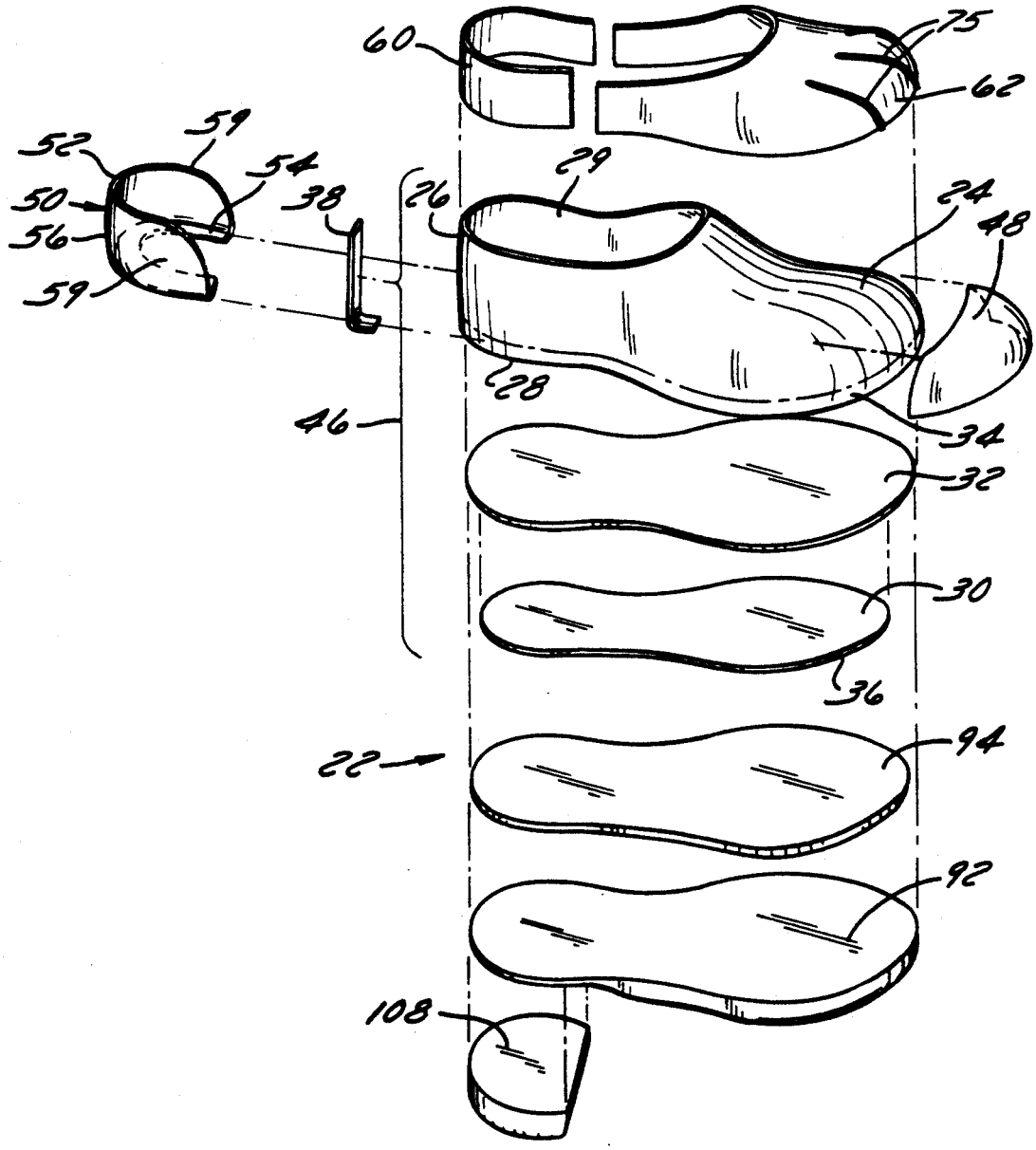
FIG. 3 is an exploded view of the components of the lower portion of the boot of FIG. 1.

As shown in FIGS. 2 and 3, an uncured lower portion 22 which becomes lower portion 14 upon vulcanization is formed by individually lasting each of the respective pieces on a forming device, such as a metal last. The metal last has the internal shape and size of the desired footwear product, such as a shoe, boot or the like. Portion 22 is formed by first providing a rubber lining 24. Rubber lining 24 is made of uncured rubber which has previously been cut from a rubber sheet stock in the shape of a shoe upper, i.e., leaving bottom and top openings 28, 29, respectively. Lining 24 is joined at its rear end 26. Lining 24 is then placed on the last. Lining 24 may optionally include an innermost fabric lining (not shown).

A rubber insole 30 is placed on the last over lower opening 28 along the bottom peripheral edge of lining 24. Preferably, filler (lining) 32 is first placed on top of insole 30 for insulation and comfort purposes. Filler 32 is slightly bigger than insole 30 and of similar shape (see FIG. 3). Filler 32 is preferably formed of a non-rubber insulating material, for example, natural, synthetic or fibrous materials such as wool, cotton, or cellulosic fibers.

Insole 30 and filler 32 are placed on the last over opening 28. Lining 24 is then lasted over insole 30 so that lower periphery 34 of lining 24 overlaps the outer peripheral edge 36 of insole 30. Overlapping edges 34, 36 of lining 34 and insole 30 meld together during vulcanization.

A piece of friction adhesive tape 38 is then placed on the back 26 of lining 24 where the edges of lining 24 meet. As shown, tape 38 is placed over lining 24 and extends the full length of back 26 from the top of lining 24 and is folded over the bottom surface of insole 30. Tape 38 thus secures lining 24 to insole 30. Additionally, the tacky exterior surface of tape 38 aids in securing other components of portion 22 in position prior to vulcanization. The resulting footwear assembly 46 includes tape 38, lining 24, insole 30 and filler 32 disposed therebetween. The other components of lower portion 14 of boot 10 are mounted on assembly 46 to complete lower portion 14.

A friction toe cap 48 is fitted on the front of assembly 46. Toe cap 48 optionally may be made of a rigid material, such as plastic. Cap 48 reinforces the toe portion of boot 10 and provides a surface on which other components can be secured.

Figure 4:
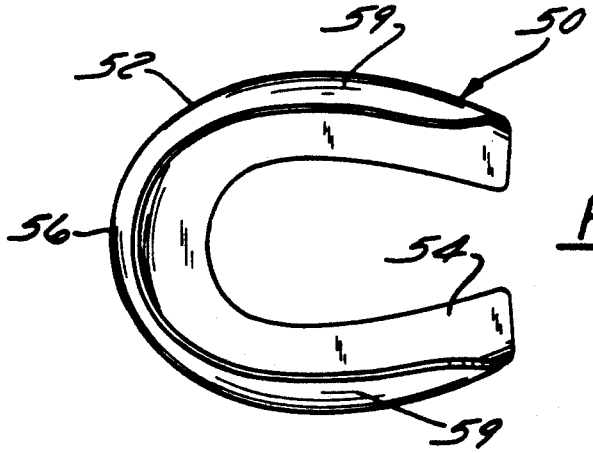
FIG. 4 is a top plan view of the heel counter shown in FIG. 3.
Figure 5:
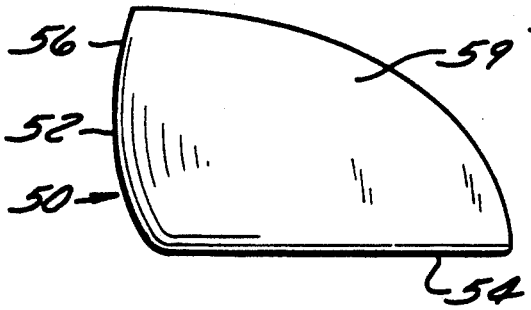
FIG. 5 is a side view of the heel counter of FIG. 4.
Figure 6:
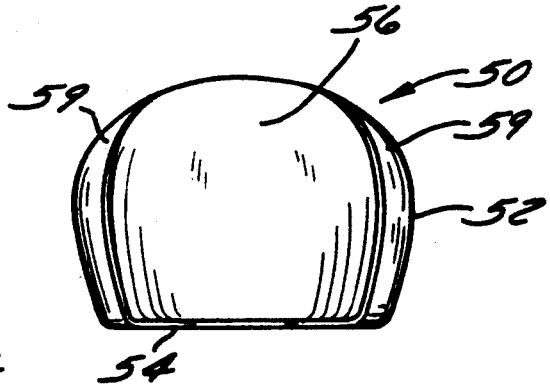
FIG. 6 is a front view of the heel counter of FIG. 4.

A rigid heel counter 50 is coated with rubber cement and then placed on the heel portion of assembly 46. A shown in FIGS. 4–6, heel counter 50 is a generally cup-shaped, contoured body formed in a generally U-shaped configuration. Heel counter 50 comprises a counter body 52 having a curved spine 56 and integral curved sidewalls 59. Body 52 has an inwardly extending, U-shaped bottom flange 54. Sidewalls 59 taper forwardly the top edge thereof forming a smooth curve as shown in FIG. 6. Sidewalls 59 and spine 56 are also curved in the vertical direction and bulge outwardly. Flange 54 extends inwardly about 0.25 to 0.5 inch. The upper surface of flange 54 engages the bottom surface of insole 30 at the interface of insole 30 and lining 24. A counter 50 having this configuration advantageously supports the entire heel area of boot 10

Counter 50 is preferably formed of a semirigid to rigid thermoplastic rubber (TPR). In this sense, "thermoplastic" refers to a polymeric material that softens when exposed to heat and returns to its original condition when cooled to room temperature. As a result, heel counter 50 can withstand vulcanization and maintain its rigid configuration when the assemblage is thereafter cooled to form lower portion 14. Natural rubbers as well as synthetics may be employed. Exemplary substances include natural crude rubber, polyvinyl chloride, nylons, linear polyethylene, polyurethane prepolymer, polystyrene, polypropylene, and cellulosic and acrylic polymers.

As noted above, heel counter 50 is coated with rubber cement, e.g., uncured rubber latex, prior to placing on assembly 46. The uncured rubber latex typically comprises uncured natural or synthetic rubber uniformly dispersed in a polar liquid such as water. These latexes are typically formulated with conventional emulsifiers or surfactant systems (natural or synthetic) to emulsify finely divided or minute uncured rubber particles. Wetting agents, cross-linking agents, tackifiers and other conventional curable rubber latex additives may also be employed. Conventional lower alkyl alcohols such as ethanol, propanol or the like, may also be added to enhance the wetting and penetration of the uncured rubber molecules and curing reagents. A commercially available natural rubber latex sold as "Northwest Latex 3003 (Neutral)", manufactured and distributed by Northwest Coating Company, is particularly useful as a cement for coating heel counter 50. Heel counter 50 is dipped into the latex solution and then dried to remove the volatile carrier, leaving an uncured rubber film on heel counter 50.

A rubber-lined friction heel pad 60 and friction vamp 62 are heated to soften the rubber then applied over heel counter 50 and toe cap 48, respectively. Pad 60 and vamp 62 are made by placing a pre-cut piece of friction material, such as a sheet of fabric, onto a gum rubber sheet. The gum rubber sheet is then cut along the outline of the pieces of friction material to form a bi-layered friction pad 60 and vamp 62 wherein the gum rubber layer slightly exceeds the size of the friction material. Pad 60 and vamp 62 are then rolled between rollers to remove any trapped air. The rubber side of vamp 62 may have decorative ridges 75.

Heel pad 60 is shaped as an elongated strip which is wrapped around the outside of heel counter 50. The gum rubber side of pad 60 faces outwardly. Counter 50 is thus secured between rubber lining 24 and rubber insole 30 on the inside and heel pad 60 on the outside. In this manner, when the lower portion 14 of boot 10 is vulcanized, the rubber cement on the inside and outside surfaces of heel counter 50 bonds it to the adjoining components.

Friction vamp 62 is heated and then applied over the front end of footwear assembly 46 covering toe cap 48. Vamp 62 is also in the form of an elongated strip symmetrically widened at its center to conform to the shape of the boot. Friction vamp 62 is placed over lining 24 and toe cap 48 with the gum rubber layer on the outside. The ends of vamp 62 overlap the ends of pad 60. Once placed on the last, pad 60 and vamp 62 are rolled with a roller to remove air pockets. The ends are pressed together to form the outer surface of lower portion 14 of boot 10.

Thereafter, upper brush guard 80 is applied over the top of liner 72 and pressed into place, e.g., with a hand tool that imparts a stitch-like pattern to the rubber. Brush guard 80 is formed of an uncured rubber strip. A lower uncured rubber brush guard 82 may also be applied (see FIG. 1).

A rag filler 94 is placed against outsole 30, and an uncured rubber outsole 92 is then placed thereover in contact with the inwardly folded edges of the other layers as shown in FIG. 2. An uncured rubber heel 108 is then secured against the rear of outsole 92. A lower brush guard 82 is pressed into place just above outsole 92.

After heel 108 has been applied to outsole 92, lower portion 22 may then be vulcanized. Vulcanization effectuates a melding together of the various uncured rubber components, into a vulcanized assembly of unitary construction. Upper portion 12 is then sewn to lower portion 14 at upper brush guard 82.

It will be understood that the above description is of a preferred exemplary embodiment of the present invention, and that the invention is not limited to the specific forms shown herein. Various substitutions, modifications, changes, and omissions may be made in the design and arrangement of the elements without departing from the spirit of the invention as expressed in the appended claims.

I claim:

1. A vulcanized rubber footwear product, comprising:

an upper portion; and a lower, generally shoe-shaped portion secured to said upper portion, said lower portion comprising an inner layer of vulcanized rubber, an outer layer of vulcanized rubber, a rigid heel counter in a heel portion thereof interposed between and enclosed by said inner and outer rubber layers, and means for securing said heel counter to at least one of said rubber layers.

2. The rubber footwear product of claim 1, wherein said heel counter is coated with a rubber latex as said securing means.

3. The rubber footwear product of claim 2, wherein said heel counter comprises a generally U-shaped, contoured body.

4. The rubber footwear product of claim 1, wherein said lower portion includes a generally shoe-shaped rubber lining as said inner rubber layer, a rubber insole secured to said lining along a bottom peripheral edge of said lining, and a rubber-lined friction heel pad as said outer rubber layer, said heel counter being secured between said rubber lining and said rubber insole on the inside and said rubber-lined friction heel pad on the outside.

5. The rubber footwear product of claim 4, wherein said rubber-lined friction heel pad includes a friction material layer positioned adjacent said heel counter.

6. The rubber footwear product of claim 5, wherein said heel counter is coated with a rubber latex as said securing means, such tat upon vulcanization of said lower portion, said coating bonds said heel counter to at least one of said rubber lining and said rubber-lined friction heel pad.

7. The rubber footwear product of claim 4, wherein said lower portion further includes a friction toe cap disposed over a toe-end portion of said lining.

8. A vulcanized rubber footwear product, comprising:

an upper portion; and a lower, generally shoe-shaped portion secured to said upper portion, said lower portion comprising an inner layer of vulcanized rubber, an outer layer of vulcanized rubber, a rigid heel counter in a heel portion thereof interposed between and enclosed by said inner and outer rubber layers, wherein said heel counter is a generally U-shaped, contoured body made of a substantially rigid thermoplastic material and is capable of maintaining its shape during vulcanization of the footwear product.

9. A vulcanizable lower portion for use in a footwear product, said lower portion comprising a rubber lining in the shape of a footwear product upper having bottom and top openings, a rubber insole joined to said rubber lining along a bottom peripheral edge of said lining, a rigid heel counter disposed over a heel-end, of said lining, and a heel pad including a rubber layer and a friction material layer covering said heel counter, wherein said heel counter is enclosed in said lower portion between said rubber lining on the inside and said heel pad on the outside.

10. The vulcanizable lower portion of claim 9, wherein said heel counter is coated with a rubber latex.

11. The vulcanizable lower portion of claim 10, wherein said friction layer of said heel pad is positioned adjacent said heel counter.

12. The vulcanizable lower portion of claim 9, further comprising a rigid toe cap fitted on the front of said lining.

13. A method of preparing a reinforced rubber footwear product comprising the steps of:

providing a rubber lining shaped as a footwear product and having top and bottom openings;

placing a rubber insole over said bottom opening;

providing a rigid heel counter;

coating said heel counter with a rubber latex coating;

placing said heel counter over heel-end portions of said rubber lining and said insole;

covering said heel counter with a friction heel pad including a rubber layer and a friction material layer, said friction layer of said heel pad being positioned adjacent said heel counter;

placing an outsole and heel onto said insole; and vulcanizing to meld together adjacent uncured rubber components of the footwear product, said rubber latex coating bonding said heel counter to said friction heel pad and said rubber lining.

14. The footwear product of claim 1, wherein said product is a boot.

* * * * *